US008939164B2

(12) United States Patent
Combs et al.

(10) Patent No.: US 8,939,164 B2
(45) Date of Patent: Jan. 27, 2015

(54) SOLAR SHADE

(71) Applicant: Berg Companies, Inc., Spokane, WA (US)

(72) Inventors: Doug Wayne Combs, Spokane, WA (US); Elisabeth Edal, Otis Ochards, WA (US); Donald R Myers, Spokane, WA (US)

(73) Assignee: Berg Companies, Inc., Spokane, WA (US)

( * ) Notice: Subject to any disclaimer, the term of this patent is extended or adjusted under 35 U.S.C. 154(b) by 0 days.

(21) Appl. No.: 13/661,985

(22) Filed: Oct. 26, 2012

(65) Prior Publication Data

US 2014/0116486 A1 May 1, 2014

(51) Int. Cl.
*E04H 15/54* (2006.01)
*E04H 15/58* (2006.01)

(52) U.S. Cl.
USPC ..... 135/115; 135/117; 135/908

(58) Field of Classification Search
USPC ..... 135/115, 117, 87, 122, 908; 52/3, 22, 52/63, 79.5
See application file for complete search history.

(56) References Cited

U.S. PATENT DOCUMENTS

| | | | | | |
|---|---|---|---|---|---|
| 1,619,740 | A * | 3/1927 | Long et al. | ..... | 135/142 |
| 2,459,026 | A * | 1/1949 | Hardy | ..... | 296/161 |
| 2,765,499 | A * | 10/1956 | Couse | ..... | 52/66 |
| 2,848,007 | A * | 8/1958 | Churchill | ..... | 135/88.18 |
| 3,683,427 | A * | 8/1972 | Burkholz et al. | ..... | 4/499 |
| 4,635,412 | A * | 1/1987 | Le Poittevin | ..... | 52/79.5 |
| 4,854,094 | A * | 8/1989 | Clark | ..... | 52/79.1 |
| 5,237,784 | A * | 8/1993 | Ros | ..... | 52/79.5 |
| 5,398,463 | A * | 3/1995 | Wright | ..... | 52/7 |
| 5,522,184 | A * | 6/1996 | Oviedo-Reyes | ..... | 52/23 |
| 5,596,844 | A * | 1/1997 | Kalinowski | ..... | 52/79.5 |
| 5,608,992 | A * | 3/1997 | Floyd | ..... | 52/3 |
| 5,761,854 | A * | 6/1998 | Johnson et al. | ..... | 52/69 |
| 5,799,680 | A * | 9/1998 | Dorflinger | ..... | 135/96 |
| 5,964,065 | A * | 10/1999 | Migurski et al. | ..... | 52/64 |
| 6,223,479 | B1 * | 5/2001 | Stockli | ..... | 52/68 |
| 7,882,659 | B2 * | 2/2011 | Gyory et al. | ..... | 52/79.5 |
| 2006/0185706 | A1 * | 8/2006 | Slade | ..... | 135/122 |
| 2010/0018131 | A1 * | 1/2010 | Green | ..... | 52/79.5 |

* cited by examiner

*Primary Examiner* — Noah Chandler Hawk
(74) *Attorney, Agent, or Firm* — Lee & Hayes, PLLC

(57) ABSTRACT

A solar shade includes a rigid frame, a flexible cover, and a supporting member to shade a portable enclosure. The solar shade provides cover to an area beyond a footprint of the portable enclosure and does not require attachment to the ground. When attached to a portable enclosure, the solar shade enables unobstructed movement around a perimeter of the portable structure by virtue of not attaching to the ground.

15 Claims, 7 Drawing Sheets

SOLAR SHADE

BACKGROUND

Shades exist for shielding the effects of the sun on portable structures. Typically, existing shades consist of a semi-opaque material and a frame that when assembled together, partially cover the portable structure. Most existing shades employ an anchor that attaches to the ground to secure the shade from wind or inclement weather conditions. The existing shades also usually contain straps, poles, or other framework that connects the anchor on the ground to the shade. However, the existing shades have limited functionality due to anchoring to the ground not always being available (i.e., temporarily anchoring to concrete), and because the straps, poles, or other framework that connects the anchor on the ground to the shade it makes it difficult to walk around the portable shelter with the shade installed. In addition, existing shades have limited sun shielding capabilities beyond a footprint of the portable structure. Further, existing shades are difficult to install due to the height of the shelters over which they are to be deployed.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1:
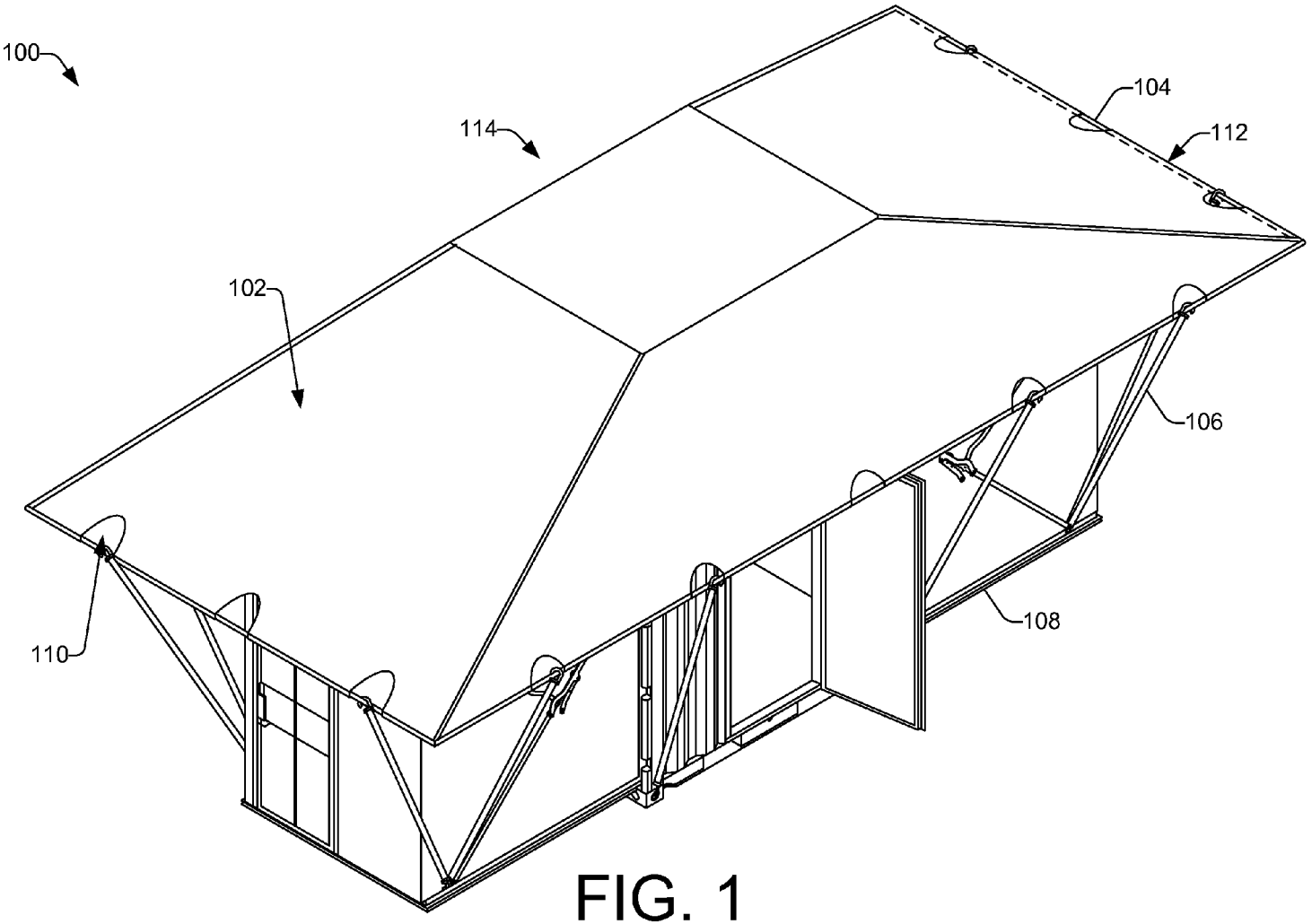
FIG. 1 depicts a perspective view of an example solar shade installed on an example portable structure.

Typically, existing solar shades consist of a cover and a frame that when assembled together diminish the effects of the sun on a portable structure. Currently available solar shades usually include an anchor for connecting the solar shade to the ground. However, the ground may be unsuitable for anchoring. For example, when the portable structure is placed on concrete or asphalt, anchoring the currently available solar shades is either not practical, or results in damage to the concrete or asphalt. In addition, when the currently available solar shades are anchored to the ground, mobility around the portable structure is limited due to obstruction caused by the anchor or the straps connecting the anchor to the solar shade. For example, the currently available solar shades do not enable a person to be covered by the solar shade while walking around the portable structure unobstructed. In addition, existing shades have limited sun shielding capabilities beyond a footprint of the portable structure while enabling movement around the perimeter of the portable structure.

This application describes an example solar shade that extends beyond the footprint of a portable enclosure without being anchored to the ground. By virtue of the solar shade extending beyond the footprint of the portable enclosure without being anchored to the ground, mobility around a perimeter of the portable enclosure is not limited by an anchor. In addition, by configuring a rigid frame for attachment above the portable enclosure, the perimeter of the portable enclosure is covered without the rigid frame causing an obstruction around the perimeter of the portable structure. Whether or not the example solar shade includes a supporting member attached between the rigid frame and a portion of the enclosure, the example solar shade, when assembled, is designed to allow a user to remain covered while moving, unobstructed, around the perimeter of the portable enclosure.

Generally, a solar shade according to this disclosure includes a rigid frame, a flexible cover attached to the rigid frame, and a supporting member. The rigid frame includes elongated members configured to attach to a portion of an enclosure and extend above a top surface of the enclosure. Additionally or alternatively, a portion of the rigid frame may extend beyond a footprint of the enclosure. In some embodiments, the rigid frame attaches to a side portion of the enclosure. For example, a plurality of poles may attach to an exterior wall of the enclosure. In one specific embodiment, the poles may removeably couple to twist-locking corner castings arranged in top and bottom corners of an expandable shelter formed of a shipping container (e.g., International Organization for Standardization (ISO) shipping container).

The solar shade further includes the flexible cover that connects to the rigid frame and shields the enclosure from sun, wind, weather, or other elements. In one embodiment, the flexible cover includes one or more passages configured to receive the elongated members of the rigid frame. In some embodiments, the flexible cover includes one or more pockets that aid in assembly of the rigid frame. For example, the one or more pockets may serve as an access point from which the elongated member is fed and/or received from the one or more passages. Additionally or alternatively, the one or more pockets in the flexible cover may expose the rigid frame such that a supporting member may be attached to the solar shade. For example, the one or more pockets may be an opening in the flexible cover, preferably on the perimeter, that exposes a portion of the rigid frame. In this way, the supporting member may be attached to the rigid frame and the enclosure to anchor the solar shade to the enclosure.

Additionally or alternatively, the flexible cover may include straps or loops. In some embodiments, the straps or loops serve as a substitute for the one or more pockets. In other embodiments, the straps or loops included in the flexible cover are used in conjunction with the one or more pockets.

The supporting member of the solar shade is configured to attach between the rigid frame, preferably at a pocket, and the enclosure. For example, one end of the supporting member may attach to the rigid frame exposed at the pocket while another end attaches to a rib, hook, hole, or opening of the enclosure. In one embodiment, the supporting member provides a tension force on the flexible cover resulting in a compression force on the rigid frame installed in the flexible cover. For example, the supporting member may include an adjustable nylon strap (e.g., a tie-down strap) that, when adjusted to a predetermined length, causes a tension force on the flexible cover resulting in a compression force on the rigid frame. The supporting member may be attached to the enclosure at any location. In some embodiments, the supporting member attaches to a lower portion of the enclosure to minimize any obstruction caused by the supporting member.

For some examples given below, the solar shade is described in the context of connecting to an expandable shelter formed from an International Organization for Standardization (ISO) shipping container. The ISO shipping container may include a standard 20 foot length, 40 foot length, 45 foot length, 48 foot length, or 53 foot length The solar shade may be connected to an expandable shelter that may be about 20 feet in length, about 8 feet in width, and about 10 feet in height. Further, the solar shade may be connected to expandable shelters that may have a length of about a third the standard 20 foot length (i.e., a TRICON), a length of about a half the standard 20 foot length (i.e., a BICON), a length of about a quarter the standard 20 foot length (i.e., a QUADCON).

The expandable shelters may be configured to include a single displaceable front, back, or side, to deploy from a stowed position adjacent to the container to a use position out and away from the container. Further, some, or all of the front, back, or sides may be displaceably deployed from a stowed position adjacent to the container to a use position out and away from the container. For example, the expandable shelters may have two expandable sides (i.e., a 3-in-1), three expandable sides (i.e., a 4-in-1), and/or four expandable sides (i.e., a 5-in-1).

While the solar shade is described as being configured to be fixed to an expandable shelter, the solar shade as described herein may be used and fixed to other structures, containers, enclosures, or buildings, or may be used and adapted with a rigid frame that may omit attachment to a structure, container, or enclosure entirely.

Illustrative Solar Shade

FIG. 1 depicts a perspective view of an example solar shade 100 installed on an example portable structure. The example solar shade 100 includes a flexible cover 102, a rigid frame 104 and one or more supporting members 106. In the illustrative example, the example solar shade 100 is shown installed on an example portable shelter 108. While the flexible cover 102 is illustrated as having a substantially rectangular shape when viewed from above, a variety of other shapes and types are contemplated. For example, when viewed from above the shape of the flexible cover 102 may be generally circular, square, ovoid, elliptical, polygonal, or any other suitable shape.

The flexible cover 102 connects to the rigid frame 104 to cover the portable shelter 108. The flexible cover 102 shields the portable shelter 108 from, for example, sun, wind, weather, or other elements. The flexible cover 102 may be constructed of any suitable material and may include, for example, polyester, Nylon, Dacron, vinyl ester, Aramid, carbon fiber, high-modulus polyethylene (HMPE), or a combination thereof. The material may further include a layered structure with an inner and/or outer coating. In one specific example, the flexible cover 102 may be constructed of sun-shading net. Additionally, the flexible cover 102 may be constructed of any material with a light passage rating between substantially one percent and substantially one hundred percent. In some specific examples, the flexible cover 102 may be constructed of any material with a light passage rating of between at least about 10% to at most about 30%. In one particular embodiment, the flexible cover 102 may be constructed of any material with a light passage rating of about 20%. Further, the flexible cover 102 may include a pattern arranged in and/or on the flexible cover 102. For example, the flexible cover 102 may include a camouflage pattern printed on the flexible cover 102 and/or formed integral with the material forming the flexible cover 102.

The rigid frame 104 connects to the portable shelter 108 and supports the flexible cover 102. The rigid frame 104 may define, at least in part, the shape of the flexible cover 102 (e.g., as viewed from the top of the cover). In the illustrated example, the rigid frame 104 connects to the portable shelter 108 by fitting into openings arranged in a wall of the portable shelter 108, such as openings in respective top and bottom castings arranged in the portable shelter 108. For example, the rigid frame 104 may connect to the portable shelter 108 by fitting cooperating fastening mechanisms (e.g., hooks, knobs, twistlocks, etc.), of one or more poles of the rigid frame 104 into cooperating openings of twist-locking castings arranged in an exterior wall of the portable shelter 108.

In the embodiment shown in FIG. 1, a portion of the rigid frame 104 defines a perimeter that extends at least partially beyond a footprint associated with the portable shelter 108. The rigid frame 104 may be constructed of any suitable material which, by way of example and not limitation, may include metal, wood, fiberglass, carbon fiber, or a composite of any of the forgoing. In some specific examples, suitable materials may include, steel, stainless steel, aluminum, plastic, thermoplastic elastomers (TPE), polyethylene (PE), polypropylene (PP), polyethylene terephthalate (PET), acrylonitrile butadiene styrene (ABS), or polyvinyl chloride (PVC). Components of the rigid frame 104 will be discussed in further detail in FIG. 2 below.

As illustrated in FIG. 1, the example solar shade 100 also includes the supporting member 106. As illustrated, the supporting member 106 is coupled to a portion of the rigid frame 104 and a portion of the portable shelter 108. Although the supporting member 106 is shown attached to a substantially lower portion of the portable shelter 108, the supporting member 106 may be attached to the portable shelter 108 at any location (top, bottom, or anywhere in between). The supporting member 106 provides a tension force on the flexible cover 102 such that the flexible cover 102 helps retain the rigid frame 104 in a set position. For example, the supporting members 106 provide a tension force on the flexible cover 102 that puts the rigid frame 104 in compression, fixing the rigid frame 104 in a set position. A length of the supporting member 106 is adjustable. For example, by adjusting (e.g., shortening and/or lengthening) the length of the supporting member 106, the flexible cover 102 may be tightened, and/or the rigid frame 104 may be adjusted relative to a top surface of the portable shelter 108. Accordingly, this adjustment changes a pitch of the example solar shade 100 relative to the top surface of the portable shelter 108. In one specific example, the supporting member 106 includes a nylon strap and a locking mechanism. However, in other embodiments, the supporting member 106 may include a cable, rope, metal strap, adjustable pole, or similar element suitable for connecting the rigid frame 104 to the portable shelter 108. The locking mechanism may be any mechanism common to one skilled in the art for adjusting the length of a strap, rope, or cable, such as a detent, ratcheting strap, cam lock strap, etc.

In the illustrated example, the example solar shade 100 is attached to the portable shelter 108 (e.g., enclosure). The portable shelter 108 may be a 3-in-1 expandable shelter. In some embodiments, the portable shelter 108 may include a TRICON, a BICON, or a QUADCON expandable shelter. In still other embodiments, the example solar shade 100 may be adapted to other structures, containers, enclosures, buildings, or shelters. For example, the example solar shade 100 made be adapted to a structure without one or more walls. Further, the solar shade 100 may be attached to a plurality of portable shelters 108. For example, the solar shade 100 may be attached to one or more 3-in-1 expandable shelters, one or more 4-in-1 expandable shelters, and/or one or more 5-in-1 expandable shelters. For example, a plurality of portable shelters 108 may be arranged to form a perimeter around an open space, and the solar shade 100 may be attached to the portable shelters 108 arranged around the perimeter to cover the portable shelters 108 and the open space.

In the embodiment shown in FIG. 1, the flexible cover 102 includes one or more pockets 110. For example, the one or more pockets 110 may serve as an access point to aid in installing the rigid frame 104 and/or attach the supporting members 106. In other examples, the one or more pockets 110 may serve as an access point from which the rigid frame 104 is fed and/or received from one or more passages 112.

Noted above, the one or more passages 112 are configured to receive components of the rigid frame 104. In some examples, the one or more passages 112 are integrated into the flexible cover 102.

The flexible cover 102 may also include a top surface 114. As illustrated in FIG. 1, the top surface 114 of the flexible cover 102 is substantially square. However, the top surface 114 may include other shapes, may be substantially planar relative to the ground surface, or may be sloped relative to the ground surface.

In some examples, the example solar shade 100 is offset a side and/or an end relative to portable shelter 108. For example, the example solar shade may be offset to the side and/or the end in response to a location of sun. This may accomplished, for example, by adjusting a length of one or more of the supporting members 106.

Figure 2A:
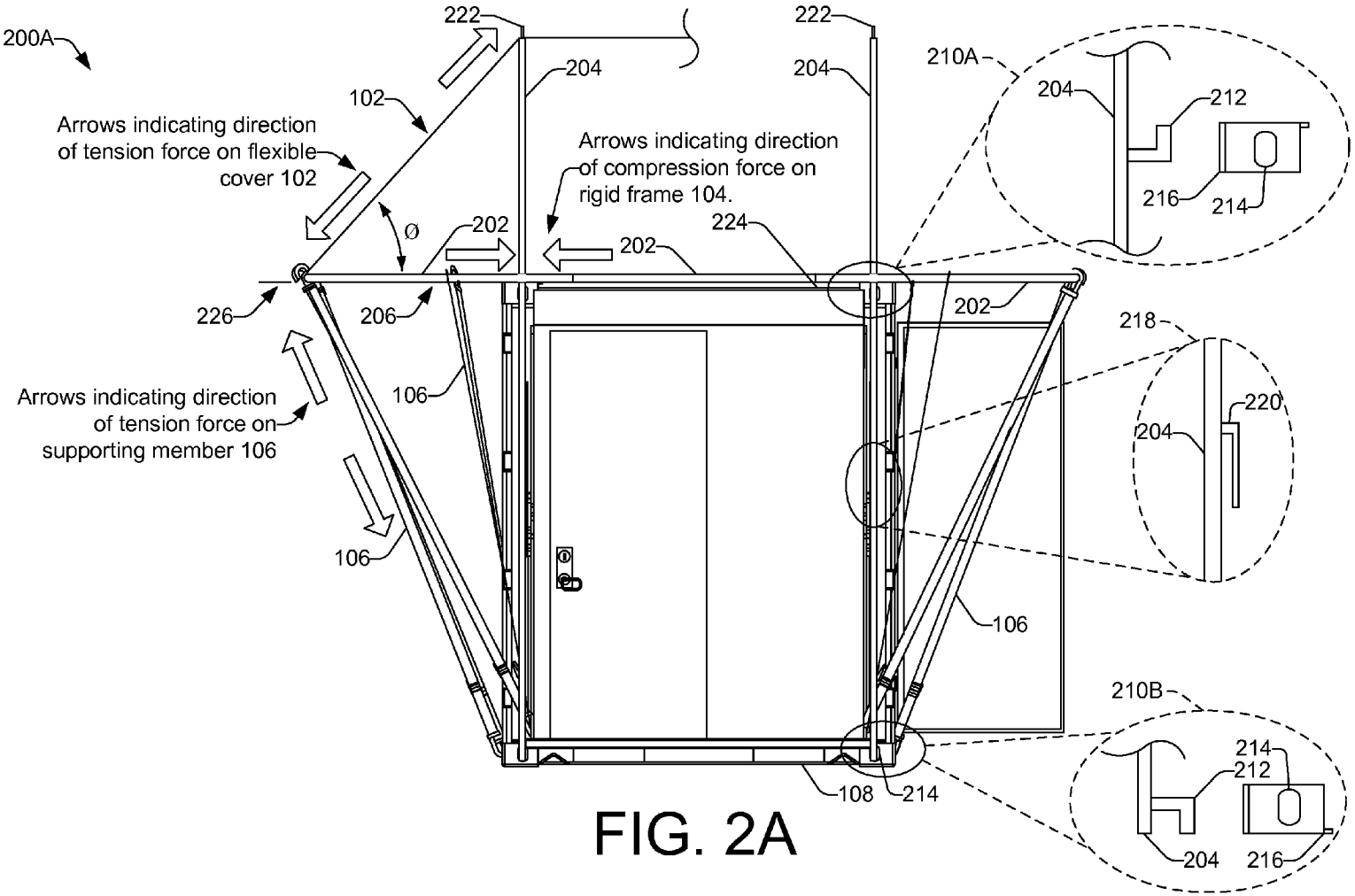
FIGS. 2A and 2B depict a front view and a side view of the rigid frame of FIG. 1 in a deployed position.
Figure 2B:
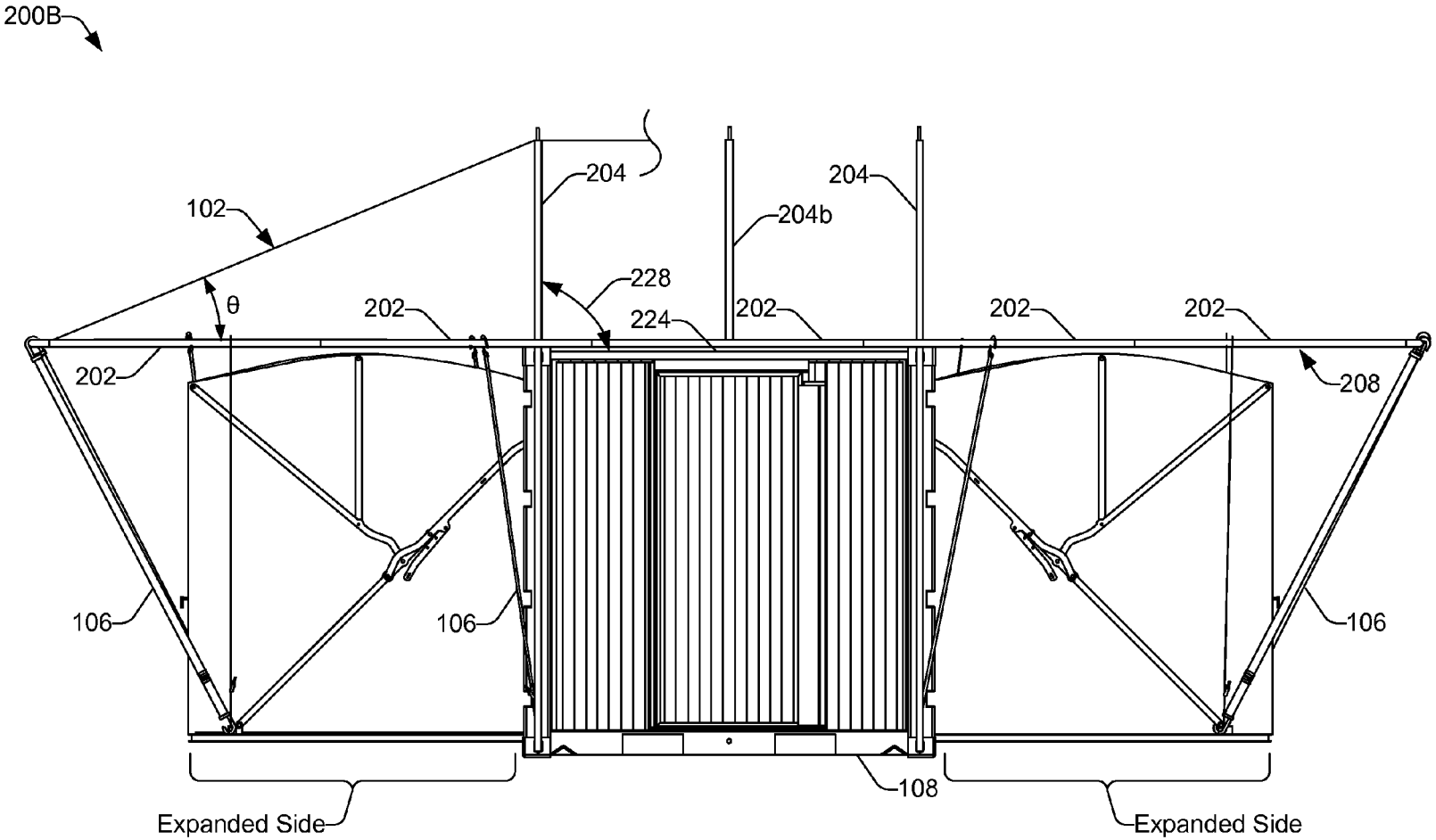

FIGS. 2A and 2B depict a front view 200A and a side view 200B of the rigid frame 104 of FIG. 1 in a deployed position. The rigid frame 104 includes a plurality of elongated members 202 and a plurality of posts 204. Each of the elongated members 202 is configured to interlock with another elongated member 202. Each of the elongated members 202 may have substantially equal lengths. Because each elongated member 202 may be the same length, one elongated member 202 may be used in place of another elongated member 202. For example, the elongated members 202 may be interchangeable. Each of the elongated members 202 may have a length of about 4 feet. The elongated members 202 may be approximately two inch round aluminum, carbon fiber, polyvinyl chloride (PVC), or fiberglass tubing. In some embodiments, two or more elongated members 202 may interlock to create an end 206 and/or a side 208 of the rigid frame 104. For example, the end 206 and/or the side 208 of the rigid frame 104 may be generated by interlocking a male connection of one elongated member 202 to a female connection of another elongated member 202. For example, three elongated members 202 may be interlocked together to form the end 206. The end 206 of the rigid frame 104 may have a length of about 12 feet, and the side 208 may have a length of about 27 feet. While FIGS. 2A and 2B illustrate two or more elongated members interlocking to form an end 206 and/or a side 208, interlocking of two or more elongated members may not be required to generate the ends and/or the sides of the rigid frame 104 as each elongated member may define the ends and/or the sides independently. Further, while rigid frame 104 is illustrated as having an end 206 length of about 12 feet and a side 208 length of about 27 feet, the lengths of the ends 206 and/or sides 208 of the rigid frame may be any length. For example, the rigid frame 104 may have an end 206 length and a side 208 length suitable to fix the solar shade 100 to a 5-in-1 expandable shelter. Here, in this example, where the solar shade is configured to be fixed to a 5-in-1 expandable shelter, the end 206 length and the side 208 length may both have a length of about 27 feet.

FIG. 2A illustrates the end 206 length of the rigid frame 104 extending beyond both sides of the portable shelter 108. The end 206 length may extend beyond both sides of the portable shelter 108 by about 2 feet. Similarly, the side 208 length may extend beyond both sides of the portable shelter 108 by about 2 feet. For example, FIG. 2B illustrates the rigid frame 104 extending beyond both expanded sides of the portable shelter 108 by about 2 feet.

The rigid frame may further comprise one or more corner fittings (not shown) that are configured to interlock with one or more of the plurality of elongated members 202. The one or more corner fittings are further configured to fit into, or be received by, the one or more passages 112 of the example solar shade 100.

As illustrated in FIGS. 2A and 2B, post 204*b* may be omitted in some embodiments. In other embodiments, a length of post 204*b* may vary relative to the plurality of posts 204 to alter a pitch of the top surface 114 of the flexible cover 102.

Each of the plurality of posts 204 may be configured to couple to a portable shelter 108. Detail views 210A and 210B illustrate the plurality of posts 204 may include cooperating fastening mechanisms 212 sufficient to lock into a complimentary opening 214 on the portable shelter 108. In some examples, the openings 214 may be arranged in castings 216 designed for use with an intermodal freight container. The castings 216 may be arranged in top and/or bottom portions of the portable shelter 108. For example, the casting 216 may be fixed to the top and bottom corners of the portable shelter 108. The cooperating fastening mechanisms 212 may be arranged to fit into or be received by the openings 214 arranged in the castings 216. For example, the cooperating fastening mechanism 212 may be a hook, a knob, a twistlock, or the like arranged to be received by the opening 214. The casting 216 may have about a 7 inch width, a 7 inch depth, and a 4.5 inch height. The opening 214 may be about a 5 inch diameter opening with two opposing substantially planar sides. The openings 214 may be substantially ovular shaped.

Detail view 218 illustrates the posts 204 may include a mechanical advantage device 220. For example, the posts 204 may include a lever, a screw, a pulley, etc. integrated with the post 204 that provides for extending and/or retracting the length of the post 204. For example, subsequent to inserting the cooperating fastening mechanisms 212 into the openings 214, the mechanical advantage device 220 may be utilized to extend a length of the post 204 to apply a force on the openings 214 to lock the post 204 to the portable shelter 108. For example, the mechanical advantage device 220 may apply a force to the opposing top and bottom castings 216 to produce a compression force on the post 204. The resulting compression force on the post 204 locks the post 204 between the castings 216. The posts 204 may include a protrusion 222 that may be inserted into the flexible cover 102. For example, the posts 204 may include a tip that is received by an aperture arranged in the flexible cover 102 to fix the posts 204 to the flexible cover 102. For example, the protrusion 222 may be inserted an aperture arranged in the flexible cover 102 to elevate the flexible cover 102 above a horizontal top surface 224 of the portable shelter 108.

As illustrated in FIGS. 2A and 2B, the rigid frame 104 is deployed when the elongated members 202 interlock together, for example, to define a perimeter. Here, the perimeter may encompass an area greater than the area defined by the footprint of the portable shelter 108. For example, the perimeter of the rigid frame 104 may extend past the footprint of the portable shelter 108 by about 2 feet. For example, the ends 206 and sides 208 of the rigid frame 104 may extend about 2 feet beyond both ends and/or both sides 208 of the portable shelter 108. Additionally or alternatively, the rigid frame 104 is deployed when the plurality of elongated members and/or the plurality of posts are coupled to a shelter (e.g., the portable shelter 108).

As illustrated in FIG. 2A, the rigid frame 104, when viewed from the front view 200A, includes an acute angle Ø relative to the horizontal top surface 224 of the portable shelter 108. For example, the acute angle Ø may be between about 20 and 80 degrees. In one specific example, the acute angle Ø is about 45 degrees.

As illustrated in FIG. 2B, the rigid frame 104, when viewed from the side view 200B, includes an acute angle θ relative to the horizontal top surface 224 of the portable shelter 108. For example, the acute angle θ may be between about 10 and 80 degrees. In one specific example, the acute angle θ is about 22 degrees.

When the rigid frame 104 is in the deployed condition, the solar shade 100 is positioned at about the horizontal top surface 224 of the portable shelter 108. For example, when the rigid frame 104 is deployed a bottom 226 of the flexible cover 102 is arranged at the horizontal top surface 224 of the portable shelter 108. Because the bottom 226 of the flexible cover 102 is arranged at the horizontal top surface 224 (i.e., about 10 feet from the bottom of the portable shelter 108), and the supporting members 106 are anchored or fixed to the portable shelter 108, a user may freely walk around the portable shelter under the solar shade 100. Further, when the rigid frame 104 is in the deployed condition, the plurality of posts 204 are at a substantially 90 degree angle 228 relative to the horizontal top surface 224 of the portable shelter 108.

Figure 2C:
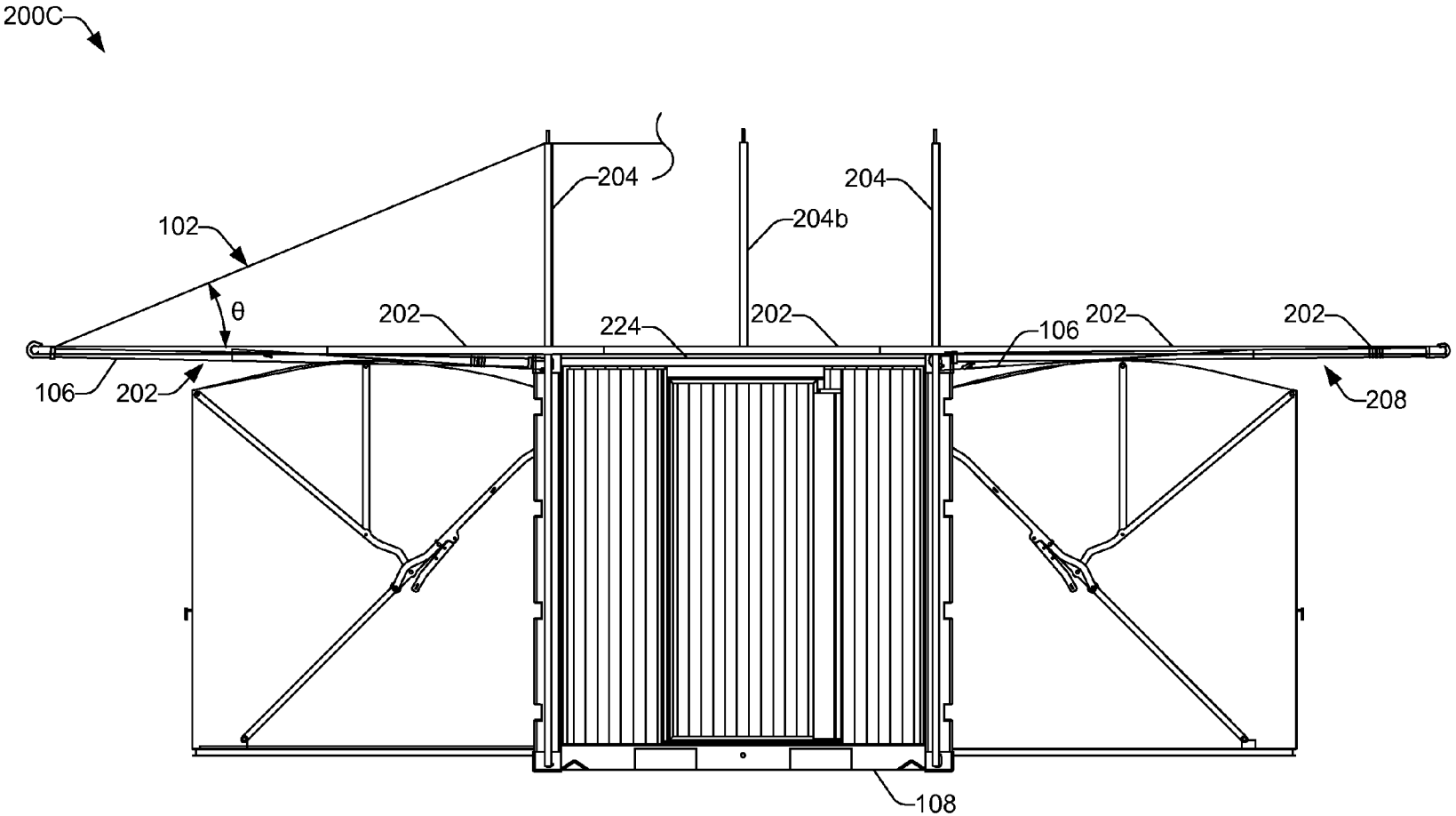
FIG. 2C depicts a side view of the rigid frame of FIG. 1 in a deployed position with supporting members in an alternate location.

FIG. 2C depicts a side view 200C of the rigid frame 104 of FIG. 1 in a deployed position with supporting members 106 in an alternate location. FIG. 2C illustrates the supporting members 106 may be fixed proximate to the horizontal top surface 224 rather than a bottom of the portable shelter 108. For example, the supporting members 106 may be fixed to the rigid frame 104 and the top castings 216 fixed in the portable shelter 108.

Figure 3:
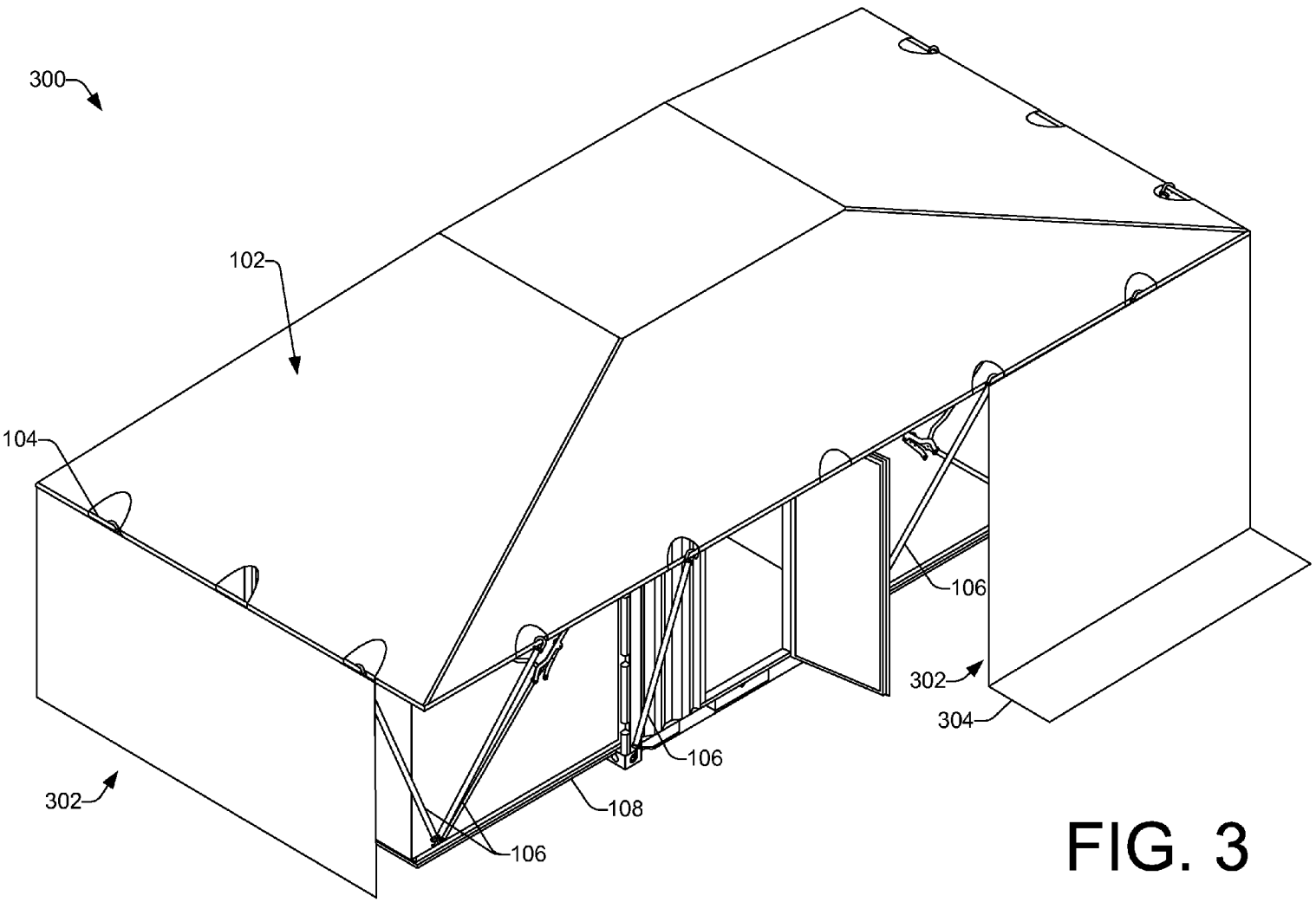
FIG. 3 is a perspective view of the example solar shade of FIG. 1 that includes curtains hanging from a perimeter of the example solar shade.

FIG. 3 is a perspective view 300 of the example solar shade 100 of FIG. 1 including one or more curtains (hereafter curtain 302) hanging from a perimeter of the rigid frame 104. The curtain 302 may comprise any suitable material to shade the portable shelter 108. In some embodiments, the curtain 302 includes netting (e.g., mosquito netting or other netting designed for pest control). In still other embodiments, the curtain 302 may be constructed of any suitable material and may include polyester, Nylon, Dacron, vinyl ester, Aramid, carbon fiber, high-modulus polyethylene (HMPE), or a combination thereof. The material may further include a layered structure with an inner and/or outer coating. In one specific example, the curtain 302 may be constructed of sun-shading net.

The curtain 302 may include a weighting mechanism 304 at a bottom portion of the curtain to minimize movement of the curtain. For example, the weighting mechanism 304 may be a flap of material arranged on a bottom edge of the curtain 302 for receiving sandbags to weight the curtain 302 down to the ground. Additionally or alternatively, the curtain 302 may include attachment means for anchoring to a surface.

Figure 4:
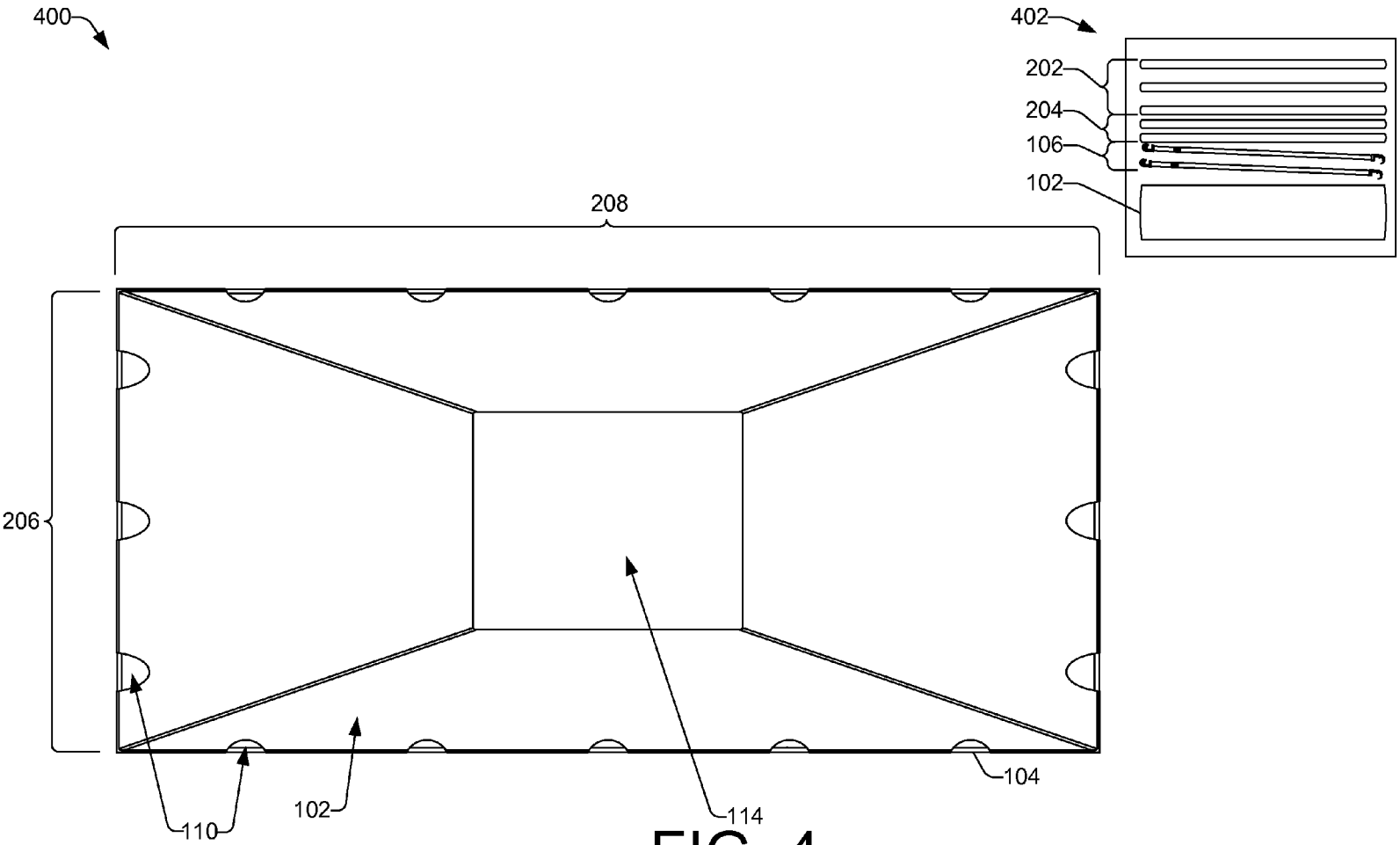
FIG. 4 depicts a top view of the example solar shade of FIG. 1.

FIG. 4 depicts a top view 400 of the example solar shade 100 of FIG. 1. The example solar shade 100 may comprise an example solar shade kit 402 that includes the flexible cover 102, the rigid frame 104, the plurality of posts 204, and the supporting members 106. In some embodiments, the example solar shade kit 402 comprises only the flexible cover 102, the rigid frame 104 including the corner fittings, and the plurality of equally sized and interchangeable elongated members 202, the plurality of posts 204, and the supporting members 106.

Illustrative Process for Solar Shade Deployment

Figure 5:
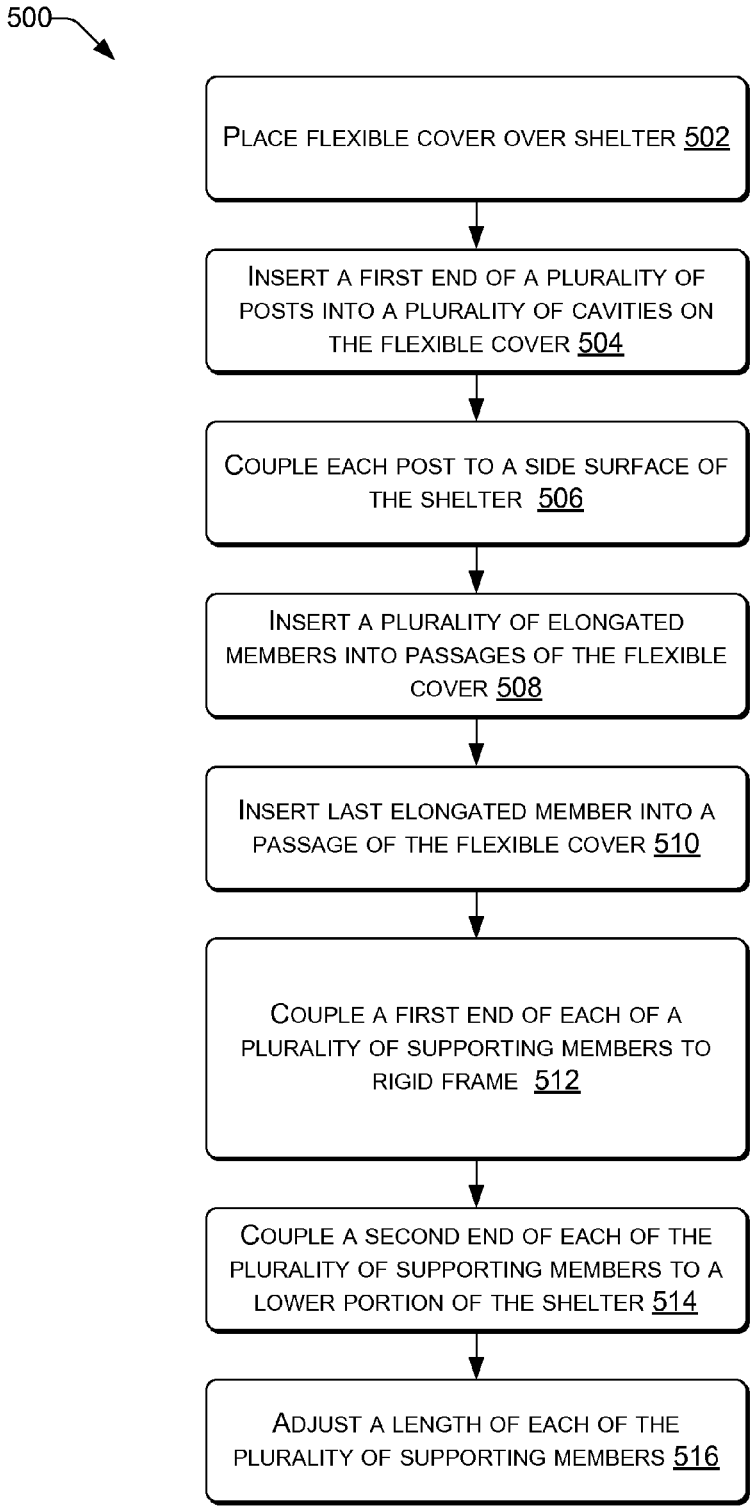
FIG. 5 is a flow diagram showing an illustrative process for setting up the example solar shade of FIG. 1.

FIG. 5 is a flow diagram showing an illustrative process 500 for setting up an example solar shade. At block 502, the process 500 includes placing a flexible cover over a top surface of a shelter. For example, the flexible cover 102 of the example solar shade 100 is placed over the horizontal top surface 224 of the portable shelter 108.

At block 504, the process 500 includes inserting a first end of a plurality of posts into a plurality of cavities on the flexible cover. For instance, a protrusion 222 on a first end of each post 204 from the plurality of posts 204 is inserted into a respective cavity on the flexible cover. In some implementations, the respective cavity may be a hole in the flexible cover that includes a grommet, or other device that defines the hole. In other implementations, the respective cavity may include a pocket that mates with the end of the post to secure the post in place relative to the flexible cover. In this way, the post supports the flexible cover and defines a top portion of the flexible cover. In some examples, four posts may be inserted into four respective cavities that collectively define a substantially square shaped top surface of the solar shade (when viewed from above).

At block 506, the process 500 includes coupling each post to a side surface of the shelter. For instance, cooperating fastening mechanisms 212 a post is locked into a complimentary opening 214 on the portable shelter 108. In one specific example, locking of the cooperating fastening mechanisms 212 to the complimentary openings 214 on the portable shelter 108 includes utilizing a mechanical advantage device 220 to extend a length of the post 204 to apply a force on the openings 214 to lock the post 204 to the portable shelter 108.

In response to locking the plurality of posts to the openings on the side of the shelter, the top surface of the flexible cover raises above the top surface of the shelter. This in turn causes a portion of the flexible cover to hang below the top surface of the shelter at an easily accessible height for inserting the plurality of elongated members 202 into the perimeter of the flexible cover. For example, the one or more passages 112 of the flexible cover 102 may be arranged at about 5 feet above the ground.

At block 508, the process 500 includes inserting a plurality of elongated members 202 into passages of the flexible cover. For example, each of a plurality of elongated members 202 is inserted into the one or more passages 112 of the flexible cover 102.

At block 510, the process 500 includes inserting the last elongated member into a passage of the flexible cover. For example, the last elongated member of the plurality of elongated members 202 is inserted into the one or more passages 112, thus defining the perimeter of the flexible over. In response to inserting the last elongated member into a passage of the flexible cover, the connections between the plurality of elongated members 202 that define the perimeter of the flexible cover cause a compression force on the rigid frame 104 that forces the perimeter of the flexible cover to elevate to its raised deployed position which is proximate to the horizontal top 224 surface of the portable shelter 108.

At block 512, the process 500 includes coupling a first end of each of a plurality of supporting members to the rigid frame. For example, the supporting members 106 may be fixed to the rigid frame 104 at each of the one or more pockets of the flexible cover.

At block 514, the process 500 includes coupling a second end of each of the plurality of supporting members to a portion of the shelter. For example, the second end of each supporting member is coupled to a lower portion of the example portable shelter 108. In some examples, coupling the end of each supporting member to the lower portion of the example portable shelter includes locking the end into a hole (e.g., a casting or a twist-locking corner casting) on the portable shelter 108. Alternatively, the supporting member 106 may be coupled to an upper and/or top portion of the portable shelter 108.

At block 516, the process 500 includes adjusting a length of each of the plurality of supporting members. For example, the length of each of the plurality of supporting members 106 may increase or decrease such that the collective adjustment of the plurality of supporting members 106 results in the perimeter of the flexible cover lowering relative to the top surface of the shelter. In this case, lowering the perimeter of the flexible cover relative to the top surface of the shelter produces a compression force on the plurality of elongated members forming the rigid frame relative to the flexible cover.

Although the process 500 is illustrated as being implemented in the architecture of FIG. 1, these processes may be performed in other architectures. Moreover, the architecture (e.g., the example solar shade 100) of FIG. 1 may be used to perform other operations.

CONCLUSION

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. For example, embodiments described herein having certain shapes, sizes, and configurations are merely illustrative. For this reason, the shapes, sizes, and configurations of the described embodiments may vary.

What is claimed is:

1. A portable solar shade comprising:

a rigid frame attached to an International Organization for Standardization (ISO) shipping container and extending above a top surface of the ISO shipping container, wherein a portion of the rigid frame extends beyond a footprint of the ISO shipping container at a height equal to or above the top surface of the ISO shipping container;

a flexible cover connected to the rigid frame;

a support member attached to the portion of the rigid frame that extends beyond the foot print of the ISO shipping container and also attached to a lower portion of the ISO shipping container; and a plurality of adjustable posts, each adjustable post removeably coupled to top and bottom corner castings of the ISO shipping container to elevate the flexible cover above the ISO shipping container.

2. The portable solar shade of claim 1, wherein the ISO shipping container is substantially a size of a 20 foot or a 40 foot long International Organization for Standardization (ISO) shipping container.

3. The portable solar shade of claim 1, wherein the ISO shipping container comprises one of a two-sided expandable enclosure, three-sided expandable enclosure, or a four-sided expandable enclosure.

4. The portable solar shade of claim 1, wherein the flexible cover is configured to allow approximately about 20% light passage through the flexible cover.

5. The portable solar shade of claim 1, wherein the rigid frame comprises approximately two inch round aluminum, carbon fiber, polyvinyl chloride (PVC), or fiberglass tubing.

6. The portable solar shade of claim 1, further comprising one or more curtains that hang from a perimeter of the rigid frame.

7. The portable solar shade of claim 6, wherein the one or more curtains that hang from the perimeter of the rigid frame comprise netting.

8. The portable solar shade of claim 1, wherein the flexible cover includes a portion that forms an angle of approximately twenty two degrees relative to the top surface of the ISO shipping container.

9. The portable solar shade of claim 1, wherein the flexible cover comprises one or more channels that connect the rigid frame to the flexible cover.

10. The portable solar shade of claim 1, wherein the flexible cover further comprises one or more pockets, and each one of the one or more pockets comprises an opening along a perimeter of the shade, the opening enabling attachment of an anchoring mechanism to the rigid frame.

11. The portable solar shade of claim 1, wherein the flexible cover further comprises one or more pockets, and each one of the one or more pockets comprise a loop connected to the flexible cover.

12. A solar shade, comprising:

a flexible cover comprising one or more passages arranged along a perimeter of the flexible cover;

a plurality of extendable posts, each extendable post removeably locked between top and bottom rigid corner supports of a shelter having at least one expandable side, wherein each extendable post removeably locks in respective apertures of the top and bottom rigid corner supports of the expandable shelter and the plurality of posts elevate the flexible cover above the expandable shelter;

a plurality of elongated members arranged in the one or more passages of the flexible cover, the plurality of elongated members extending the flexible cover beyond a foot print of the expandable shelter when the at least one expandable side is in a use position out away from the expandable shelter; and wherein the flexible cover is arranged above a top surface of the expandable shelter enabling unobstructed movement under the flexible cover while the flexible cover is in the deployed position.

13. The solar shade of claim 12, wherein each extendable post comprises a mechanical advantage device to extend the respective extendable post between the top and bottom rigid corner supports of the expandable shelter, wherein extending each extendable post applies a force on the top and bottom rigid corner supports of the expandable shelter to removeably lock each extendable post between top and bottom rigid corner supports.

14. A solar shade, comprising:

a flexible cover elevated above an enclosure, the enclosure comprising a front surface opposite a back surface, and two sides between the front surface and the back surface, wherein at least one of the two sides comprises an expandable side arranged to be deployed from a stowed position adjacent to the enclosure to a use position out and away from the enclosure;

a rigid frame attached to a perimeter of the flexible cover, the rigid frame elevated above the enclosure and extending the flexible cover beyond a footprint of the enclosure when the expandable side is in the use position out away from the enclosure;

an adjustable post removeably coupled to top and bottom rigid corner supports of the enclosure on the front surface, and another adjustable post removeably coupled to top and bottom rigid corner supports of the enclosure on the back surface, and wherein each adjustable post removeably locks in respective apertures of the top and bottom rigid corner supports of the enclosure and extends above the enclosure and supports the flexible cover elevated above the enclosure.

15. The solar shade of claim 14, wherein the second side comprises another expandable side arranged to be deployed from a stowed position adjacent to the enclosure to a use position out and away from the enclosure, and the rigid frame attached to the perimeter of the flexible cover extends the flexible cover beyond a footprint of the enclosure when the two expandable sides are in the use positions out away from the enclosure.

* * * * *